US008053620B2

(12) United States Patent
Sohn et al.

(10) Patent No.: US 8,053,620 B2
(45) Date of Patent: Nov. 8, 2011

(54) GUARD BED FOR REMOVING CONTAMINANTS FROM FEEDSTOCK TO A NORMAL PARAFFIN EXTRACTION UNIT

(75) Inventors: Stephen W. Sohn, Arlington Heights, IL (US); Mark G. Riley, II, Hinsdale, IL (US)

(73) Assignee: UOP LLC, Des Plaines, IL (US)

( * ) Notice: Subject to any disclaimer, the term of this patent is extended or adjusted under 35 U.S.C. 154(b) by 398 days.

(21) Appl. No.: 12/165,096

(22) Filed: Jun. 30, 2008

(65) Prior Publication Data

US 2009/0326305 A1 Dec. 31, 2009

(51) Int. Cl.
*C07C 7/12* (2006.01)

(52) U.S. Cl. ..... 585/820; 208/213; 208/250; 208/57; 585/802; 585/829; 585/831

(58) Field of Classification Search ..... None
See application file for complete search history.

(56) References Cited

U.S. PATENT DOCUMENTS

| | | | | |
|---|---|---|---|---|
| 4,176,053 | A * | 11/1979 | Holcombe | 208/310 Z |
| 4,963,248 | A | 10/1990 | Yano et al. | |
| 5,041,693 | A | 8/1991 | Zarchy | |
| 5,045,178 | A | 9/1991 | Maruyama et al. | |
| 2005/0252831 | A1* | 11/2005 | Dysard et al. | 208/212 |

FOREIGN PATENT DOCUMENTS

| | | |
|---|---|---|
| BE | 755625 | 3/1971 |
| DE | 2043578 | 3/1971 |
| DE | 3876917 | 2/1993 |
| EP | 308962 | 3/1989 |
| EP | 308962 | 12/1992 |
| ES | 2053664 | 8/1994 |
| FR | 2060354 | 6/1971 |
| GB | 1324503 | 7/1973 |
| GB | 1454180 | 10/1976 |
| GB | 1510705 | 5/1978 |
| JP | 1163139 | 6/1989 |
| JP | 1168629 | 7/1989 |
| JP | 2247135 | 10/1990 |
| JP | 2247137 | 10/1990 |
| JP | 4016450 | 3/1992 |
| JP | 1726445 | 1/1993 |

(Continued)

OTHER PUBLICATIONS

Fukunaga, T. et al.; Development of kerosene fuel processing system for PEFC; Catalysis Today, 2003, 197-200 (Abstract Only).

(Continued)

*Primary Examiner* — Tam M Nguyen
(74) *Attorney, Agent, or Firm* — Arthur E. Gooding

(57) ABSTRACT

Processes and systems for removing contaminants from a paraffin containing feedstock are provided that include: providing a paraffin containing feedstock, passing the paraffin containing feedstock to an inlet of a guard bed that includes an adsorbent material, and contacting the paraffin containing feedstock with the adsorbent material in the guard bed to produce a treated paraffin containing feedstock. The processes and systems can also include removing the treated paraffin containing feedstock from an outlet of the guard bed, and passing the treated paraffin containing feedstock to a paraffin separation zone that separates normal paraffins from the treated paraffin containing feedstock.

13 Claims, 1 Drawing Sheet

FOREIGN PATENT DOCUMENTS

| | | |
|---|---|---|
| JP | 6039432 | 5/1994 |
| JP | 6305988 | 11/1994 |
| JP | 2520723 | 7/1996 |
| JP | 2520725 | 7/1996 |
| JP | 2001294871 | 10/2001 |
| JP | 3402488 | 5/2003 |
| KR | 9604868 | 4/1996 |
| NL | 7012741 | 3/1971 |

OTHER PUBLICATIONS

Sultanov, N. et al.; Activity of adsorbents in the removal of heteroorganic compounds from light petroleum products; Khimiya i Tekhnologiya Topliv i Masal, 1987, 10-11 (Abstract Only).

Al-Khaidar, KH. Y. et al.; Separation of sulfur compounds from kerosine fractions; Azarbaycan Neft Tasarrufati, 1980, 56-59 (Abstract Only).

Benashvili, E. M. et al.; Desulfurization of the kerosine fraction of petroleum on natural and modified clinoptilolites; 1979 (Abstract Only).

Benashvili, E. M. et al.; Adsorption separation and study of normal paraffinic hydrocarbons from ligroine-kerosine fractions of Samgorsk petroleum and a mixture of Samgorsk, Grozny, and Shaimsk crudes; Soobshcheniya Akademii Nauk Gruzinskoi SSR, 1979, 369-372 (Abstract Only).

Mikhal'Skaya, L. I. et al.; Adsorption of sulfur compounds from kerosene by zeolite; Khimiya i Khimicheskaya Tekhnologiya, 1975, 64-66 (Abstract Only).

Lobanova, G. A. et al.; Extraction of sulfides from petroleum products by adsorbents; Khimiya i Tekhnologiya Topliv i Massel, 1975, 20-23 (Abstract Only).

Mikhal'Skaya, L. I.; Demercaptanization of aviation kerosene on a zeolite; Khimiya i Khimicheskaya Tekhnologiya, 1975, 86-90 (Abstract Only).

Makhlitt R. et al.; Adsorption properties of different adsorbents for sulfur compounds of a fraction of jet fuels; Izvestiya Vysshikh Uchebnykh Zavedenii, Neft i Gaz, 1974, 43-48 (Abstract Only).

* cited by examiner

GUARD BED FOR REMOVING CONTAMINANTS FROM FEEDSTOCK TO A NORMAL PARAFFIN EXTRACTION UNIT

TECHNICAL FIELD

The processes and systems described herein relate to removing contaminants from a paraffin containing feedstock.

DESCRIPTION OF RELATED ART

Products obtained from paraffin containing feedstocks are useful in a number of applications. In the lighter hydrocarbon range, isoparaffins tend to have a high octane value and desirable gasoline alkylation characteristics. In the heavier hydrocarbon range, linear paraffins, also known as normal paraffins, tend to be desirable for the benefits derived from their linearity in the production of plasticizers, linear alkylbenzene sulfonates; detergent alcohols, and ethoxylates. For example, normal paraffins having carbon numbers in the range of $C_6$ to $C_{10}$ can be used for plasticizers, normal paraffins having carbon numbers in the range $C_{10}$ to $C_{14}$ can be used for linear alkylbenzenes, and normal paraffins having carbon numbers in the range $C_{10}$ to $C_{18}$+ can be used for detergent alcohols.

One example of a commercial use for linear paraffins is in the making of detergents. Detergents made from linear alkylbenzene sulfonates (LABs) have become popular because they have been found to biodegrade more rapidly than detergents made from branched alkylbenzene sulfonates. The petrochemical industry produces LABs by dehydrogenating normal paraffins to linear olefins and then alkylating benzene with the linear olefins in the presence of HF. The normal paraffins can be a mixture of linear paraffins having different numbers of carbon atoms per molecule. For example, the normal paraffins can be $C_6$ to $C_{22}$, or $C_{10}$ to $C_{15}$. More narrow ranges tend to be preferred, such as $C_{10}$ to $C_{12}$, or from $C_{10}$ to $C_{13}$.

The recovery of normal paraffins from paraffin containing feedstocks can be accomplished in various ways. One process that has been developed for the production of normal paraffins is the Molex process developed by UOP, in Des Plaines, Ill. The UOP Molex process is a method for the liquid-phase adsorptive separation of normal paraffins from isoparaffins and cycloparaffins. Other processes for the production of normal paraffins include vapor-phase processes.

SUMMARY

The processes and systems described herein relate to removing contaminants from a paraffin containing feedstock. More particularly, the processes and systems described herein relate to removing contaminants from a paraffin containing feedstock prior to the feedstock undergoing a process for separating the normal paraffins from the paraffin containing feedstock.

In one aspect, a process for removing contaminants from a paraffin containing feedstock is provided that includes providing a paraffin containing feedstock, passing the paraffin containing feedstock to an inlet of a guard bed that includes an adsorbent material, and contacting the paraffin containing feedstock with the adsorbent material in the guard bed to produce a treated paraffin containing feedstock. The step of contacting can remove contaminants from the paraffin containing feedstock. The process also includes removing the treated paraffin containing feedstock from an outlet of the guard bed, and passing the treated paraffin containing feedstock to a paraffin separation zone that separates normal paraffins from the treated paraffin containing feedstock. The paraffin containing feedstock can be derived from a kerosene boiling range petroleum fraction. The paraffin containing feedstock can also be hydrotreated prior to being passed to the inlet of the guard bed.

In another aspect, a system for removing contaminants from a paraffin containing feedstock is provided that includes a hydrotreating zone that receives a paraffin containing feed stock and produces a hydrotreated paraffin containing feedstock, a guard bed, and a paraffin separation zone that receives the treated paraffin containing feedstock and separates normal paraffins from the treated paraffin containing feedstock. The guard bed can have an inlet that receives the paraffin containing feedstock, a fixed bed where the paraffin containing feedstock contacts an adsorbent material to produce a treated paraffin containing feedstock, and an outlet from which the treated paraffin containing feedstock is removed from the guard bed.

BRIEF DESCRIPTION OF THE DRAWINGS

Specific examples have been chosen for purposes of illustration and description, and are shown in the accompanying drawings, forming a part of the specification.

DETAILED DESCRIPTION

Figure 1:
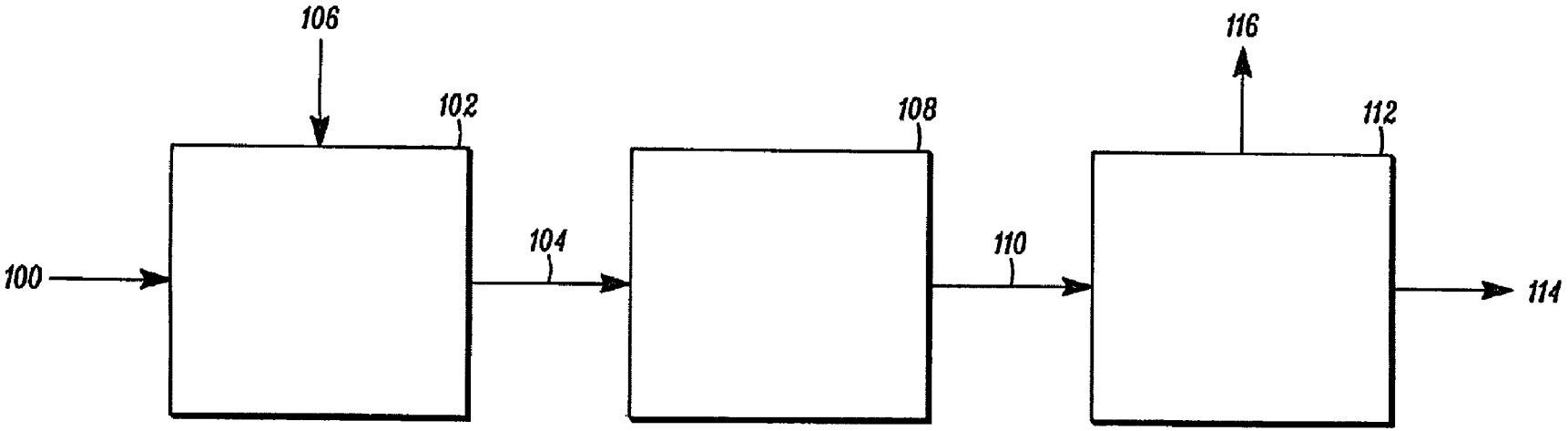
FIG. 1 illustrates a simplified schematic diagram of a hydrotreating zone, a guard bed and a paraffin separation zone.

Paraffin containing feedstocks can be any feedstock containing a mixture of normal paraffins and non-normal paraffins, such as, for example, isoparaffins and/or cycloparaffins. Paraffin containing feedstocks preferably comprise $C_{10}$ to $C_{13}$ hydrocarbons. For example, paraffin containing feedstocks and can comprise $C_{10}$ hydrocarbons, $C_{11}$ hydrocarbons, $C_{12}$ hydrocarbons, $C_{13}$ hydrocarbons, and mixtures thereof.

Paraffin containing feedstocks can be derived from hydrocarbon feedstocks that contain other normal and non-normal hydrocarbons, such as olefins, di-isoparaffins, di-isoolefins, naphthenes and aromatics. For example, a paraffin containing feedstock can be derived from a kerosene boiling range petroleum fraction. A kerosene boiling range petroleum fraction can generally be produced by fractionating crude oil. Crude oil is the liquid part, after being freed from dissolved gas, of petroleum, a natural organic material composed principally of hydrocarbons that occur in geological traps. The kerosene boiling range fraction can contain a mixture of different hydrocarbons, including mostly paraffinic and aromatic hydrocarbons, but can also containing olefinic and naphthenic hydrocarbons. The kerosene boiling range fraction is usually defined as comprising a fraction having a boiling range of from about 149° C. (about 300° F.) to about 300° C. (about 572° F.). The initial boiling point of the kerosene boiling range fraction may vary from about 149° C. (about 300° F.) to about 190° C. (about 374° F.), and the final boiling point may vary from about 235°C. (about 455° F.) to about 300° C. (about 572° F.). The kerosene boiling range generally includes hydrocarbons having from about 8 to about 17 carbon atoms. The content of the normal paraffins in a kerosene boiling range petroleum fraction, can be from about 15% by volume to about 35% by volume of the kerosene boiling range petroleum fraction, but is preferably greater than about 20% by volume of the kerosene boiling range petroleum fraction, and is more preferably equal to or greater than about 25% by volume of the kerosene boiling range petroleum fraction. The kerosene boiling range petroleum fraction can be a vapor, a liquid, or a two-phase, vapor-liquid mixture. A two-phase, vapor-liquid mixture can, for example, have from about 5 mole percent vapor phase to about 30 mole percent vapor phase.

In order to obtain a paraffin containing feedstock derived from a kerosene boiling range petroleum fraction, the kerosene boiling range petroleum fraction can be fractionated to produce a fractionated stream containing hydrocarbons having the desired range of carbon atoms. The kerosene boiling range petroleum fraction can be fractionated in any suitable manner, including, but not limited to, in a dividing wall fractionation column, or in two fully thermally coupled fractionation column, such as a prefractionator and a main column.

In some examples, the paraffin containing feedstock is hydrotreated prior to being passed to the inlet of the guard bed. In instances where the paraffin containing feedstock is derived from a kerosene boiling range petroleum fraction that has been fractionated, the fractionated stream is preferably hydrotreated to produce the paraffin containing feedstock.

In the example illustrated in FIG. 1, a paraffin containing feedstock 100, which can be a fractionated stream from a kerosene boiling range petroleum fraction, can be provided to a hydrotreating zone 102. A hydrogen containing stream 106 can be introduced to the hydrotreating zone 102 and can react with sulfur contaminants, nitrogen contaminants, or both, in the paraffin containing feedstock 100. Hydrotreating zone 102 produces a hydrotreated paraffin containing feedstock 104, preferably having reduced levels of sulfur contaminants, nitrogen contaminants, or both. The hydrotreating zone 102 can have any suitable arrangement, including a flow scheme, a catalyst, and operating conditions that facilitate the removal or reduction of olefins, as well as sulfur and nitrogen contaminants.

Hydrotreated paraffin containing feedstock 104 can be to an inlet of a guard bed 108. Guard bed 108 can include an adsorbent material. The guard bed 108 preferably includes a fixed bed that includes the adsorbent material. The paraffin containing feedstock can be contacted with the adsorbent material in the guard bed 108 to produce a treated paraffin containing feedstock 110.

The adsorbent material can include a molecular sieve material, such as zeolites. The molecular sieve material preferably has an average pore size less than or equal to about 5 angstroms. In some examples, the molecular sieve material can have an average pore size of about 3 angstroms, about 4 angstroms, or about 5 angstroms. Such molecular sieve material can include, but is not limited to SGB-11, 5A-1HP, RK 38HP, PSA adsorbent H-15, K-A, Na-A, and Ca-A. The adsorbent material can also include at least one binder. One suitable type of binder includes clay materials, such as, for example, a kaolin clay, a metakaolin clay, an atapulgite clay, or a smectite clay. Preferably, the adsorbent does not cause isomerization, or discoloration of the paraffin containing feedstock. In at least some examples, the adsorbent material is sacrificial, and is replaced once it is spent rather than being regenerated. In such examples, it is preferred that the adsorbent have a useful life of up to about 3 years, or but actual adsorbent life will be dependent upon the contaminant level.

The guard bed 108 can have an operation temperature of from about 100° C. to about 225° C., from about 150° C. to about 180° C. Preferably, the operation temperature of the guard bed 108 is equal to, or within about 5° C. of the operation temperature of the paraffin separation zone 112 that is downstream of the guard bed 108. Guard bed operation temperatures above about 225° C. can result in color body formation and discoloration of the paraffin containing feedstock.

The guard bed 108 can have a liquid hourly space velocity (LHSV) from about 0.5 $h^{-1}$ to about 4 $h^{-1}$, and preferably has an LHSV of about 2 $h^{-1}$.

Contacting the paraffin containing feedstock with the adsorbent material in the guard bed 108 can remove contaminants from the paraffin containing feedstock. Removal of contaminants can be any level of removal, including a complete removal, or a partial removal such as a reduction. The contaminants in a paraffin containing feedstock, or hydrotreated feedstock 104 can be, for example, undesirable sulfur species, such as benzothiophenes and thiophenes, including alkylated benzothiophenes and alkylated thiophenes. In one example, the guard bed 108 can remove thiophenic compounds by forming dimmers or trimers on the surface of the adsorbent material.

The treated paraffin containing feedstock can be removed from an outlet of the guard bed 108, and can be passed to a paraffin separation zone 112 that separates normal paraffins from the treated paraffin containing feedstock 110 to produce a normal paraffin containing stream 114. Paraffin separation zone 112 also produces a raffinate stream 116. Raffinate stream 116 can include hydrocarbons, such as naphthenes, aromatics, and branched paraffins. Paraffin separation zone 112 can separate normal paraffins from the treated paraffin containing feedstock by any suitable process, such as, for example, by a liquid-phase adsorptive separation process.

Normal paraffin containing stream 114 can undergo further processing, such as, for example, dehydrogenation to produce an olefin containing stream, and alkylation to produce LABs.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A process for removing sulfur and nitrogen containing contaminants from a paraffin containing feedstock, the process comprising:

providing a kerosene boiling range petroleum fraction;

fractionating the kerosene boiling range petroleum fraction with a high bromine index to produce a liquid fractionated stream;

hydrotreating the fractionated stream to produce the paraffin containing feedstock with a lower bromine index compared to the bromine index of the fractionated stream;

providing the liquid paraffin containing feedstock, wherein the feedstock comprises $C_{10}$ to $C_{13}$ hydrocarbons;

passing the paraffin containing feedstock to an inlet of a guard bed, wherein the guard bed includes an adsorbent material consisting of a molecular sieve and a binder;

contacting the paraffin containing feedstock with the adsorbent material in the guard bed to produce a treated paraffin containing feedstock having a reduced thiophenic content relative to the paraffin containing feedstock entering the guard bed;

removing the treated paraffin containing feedstock from an outlet of the guard bed; and passing the treated paraffin containing feedstock to a liquid phase paraffin separation zone that separates normal paraffins from the treated paraffin containing feedstock.

2. The process of claim 1, wherein the paraffin separation zone separates normal paraffins from the treated paraffin containing feedstock by a liquid-phase adsorptive separation process.

3. The process of claim 1, wherein the guard bed comprises a fixed bed that includes the adsorbent material.

4. The process of claim 1, wherein the molecular sieve material has an average pore size less than or equal to about 5 angstroms.

5. The process of claim 1, wherein the molecular sieve material comprises zeolites.

6. The process of claim 1, wherein the binder comprises a kaolin clay, a metakaolin clay, an atapulgite clay, or a smectite clay.

7. A process for removing sulfur and nitrogen containing contaminants from a paraffin containing feedstock, the process comprising:

providing a liquid paraffin containing feedstock derived from a kerosene boiling range petroleum fraction having a low olefin content;

passing the paraffin containing feedstock to an inlet of a guard bed, wherein the guard bed includes an adsorbent material consisting of a zeolite and a binder;

contacting the paraffin containing feedstock with the adsorbent material in the guard bed to remove sulfur containing contaminants from the paraffin containing feedstock and produce a treated paraffin containing feedstock, having a reduced thiophenic content;

removing the treated paraffin containing feedstock from an outlet of the guard bed; and passing the treated paraffin containing feedstock to a liquid phase paraffin separation zone that separates normal paraffins from the treated paraffin containing feedstock.

8. The process of claim 7, wherein the paraffin containing feedstock comprises $C_{10}$ to $C_{13}$ hydrocarbons.

9. The process of claim 7, wherein the paraffin containing feedstock is hydrotreated prior to being passed to the inlet of the guard bed.

10. The process of claim 9, wherein the paraffin containing feedstock is fractionated prior to being hydrotreated.

11. The process of claim 7, wherein the guard bed comprises a fixed bed that includes the adsorbent material.

12. The process of claim 7, wherein the adsorbent material comprises zeolites having an average pore size of about 5 angstroms.

13. The process of claim 12, wherein the binder comprises clay.

* * * * *